US006379238B1

(12) United States Patent
Beechey et al.

(10) Patent No.: US 6,379,238 B1
(45) Date of Patent: Apr. 30, 2002

(54) FINISHING AND ABRASIVE TOOL

(75) Inventors: Timothy J. J. Beechey, Cambridge (CA); Mark K. Van Voorhis, Dexter, MI (US)

(73) Assignee: Jason Incorporated, Conover, NC (US)

( * ) Notice: Subject to any disclaimer, the term of this patent is extended or adjusted under 35 U.S.C. 154(b) by 0 days.

(21) Appl. No.: 09/851,279

(22) Filed: May 8, 2001

(51) Int. Cl.[7] ..... B24D 11/00

(52) U.S. Cl. ..... 451/532; 451/466; 451/537; 451/539

(58) Field of Search ..... 15/230.14, 230.15, 15/230.16, 181, 223; 451/466, 526, 532, 533, 537, 539, 548

(56) References Cited

U.S. PATENT DOCUMENTS 4,714,644 A * 12/1987 Rich ..... 451/539
5,125,192 A * 6/1992 Welsch ..... 451/538
5,142,829 A * 9/1992 Germain ..... 451/510
5,405,286 A * 4/1995 Welsch ..... 451/527

* cited by examiner

*Primary Examiner*—Timothy V. Eley
(74) *Attorney, Agent, or Firm*—Renner, Otto, Boisselle & Sklar, LLP

(57) ABSTRACT

A finishing star or spinner abrasive tool is formed of inner and outer packs of square sheets of abrasive cloth or sandpaper with the inner packs angularly offset from the outer packs on the mandrel axis. Each sheet is formed with discontinuous radial slits extending beyond an unslit center section around a center fastener forming the mandrel drive hole. The slits provide surface flexibility while maintaining sheet integrity as it wears to circular form. An optional backing core is provided in the middle of the tool in the form of a cloth-sisal quilt acting as a cushion backing for the sheets, and which may retain coolant or compound during operation. The tool has longer working life with improved flexibility and working characteristics.

13 Claims, 2 Drawing Sheets

FINISHING AND ABRASIVE TOOL

DISCLOSURE

This invention relates generally as indicated to a finishing and abrasive tool and, more particularly, to an abrasive spinner or finishing star tool having enhanced flexibility and a longer useful life.

BACKGROUND OF THE INVENTION

Squares, cross pads and stars, called spinners, are forms of abrasive tools and are special application abrasive tools used for a variety of purposes. Each uses rectangular or square pads or bundles of sand paper or abrasive cloth with the tool being mounted on an arbor going through the center. Square pads, for example, may be used for grinding or blending of corners or for spot facing. As the pad rotates, the corners wear down and the tool becomes round. They abrade or cut almost as fast as hard wheels, but are easier to control and are more suitable for certain surfaces and shapes.

Cross pads are used for grinding, polishing and deburring as well as spot facing. One application is the ends of tubes or holes, both inside and out, for bell-mouth configurations, and chamfering. Cross pads have a generally x-shape configuration and this allows the operator to see the work since it is not completely obscured by the tool.

A star, sometimes called a finishing star, is something of a combination of both usually made from several packs of square abrasive sheets which are offset from each other on the rotational axis of the tool. For example, a star may be formed of at least two outside packs of abrasive sheets and at least two inside packs, with the inside packs each aligned and the outside packs each aligned, but the inside and outside packs offset 45°. This produces an eight-pointed symmetrical star. Additional packs offset symmetrically may produce stars with more points. The packs are usually held together with a two-part coined or swaged hole forming fastener with internal threads.

One of the problems with such tools is maintaining the desired flexibility for conformance to the work, particularly edges, ridges or projections, while at the same time providing enough rigidity, cushion or backup to perform the work properly. Too much of either characteristic will considerably shorten the tool life. Accordingly, there is a need for such a tool having both characteristics and longer tool life.

SUMMARY OF THE INVENTION

A rotary abrasive tool in the form of a star utilizes angularly offset packs of abrasive sheets or sand paper with each sheet radially slit, but with discontinuous slits. The discontinuous radial slits keep the slits from forming separate fingers which might break off in use but provide the desired surface flexibility for proper work application. An internally threaded two-part fastener secures the packs together and forms the center arbor hole. The middle of the tool may be provided with a cloth-sisal quilt to provide both a cushioning backing, and serve as a device to retain coolant or buffing or abrading compound applied to the tool. The cloth-sisal quilt core comprises outer cloth layers sewn to a sisal core and is the same square or rectilinear shape as the abrasive sheet or sand paper packs. The components of the quilt may be joined with a variety of sewing patterns and the quilt may be subject to dip treatments to improve working characteristics and wear.

A tool may typically comprise at least an outer pack of three or more abrasive coated square sheets, at least an inner pack offset 45° on the mandrel axis, the cloth-sisal core also offset 45°, another inner pack also offset 45°, and an opposite outer pack aligned with the original outer pack. Such a tool provides an eight-point star with each point formed by a projecting corner of the packs, as an equilateral triangle. Additional packs which are symmetrically offset may produce a star with more points. The abrasive on the sheets may face in or out, or in both directions in a variety of patterns. The tools may vary in size from a diameter of about two inches to a diameter of about eight inches or more. The tool has improved flexibility and work characteristics, and, importantly, a longer useful life.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
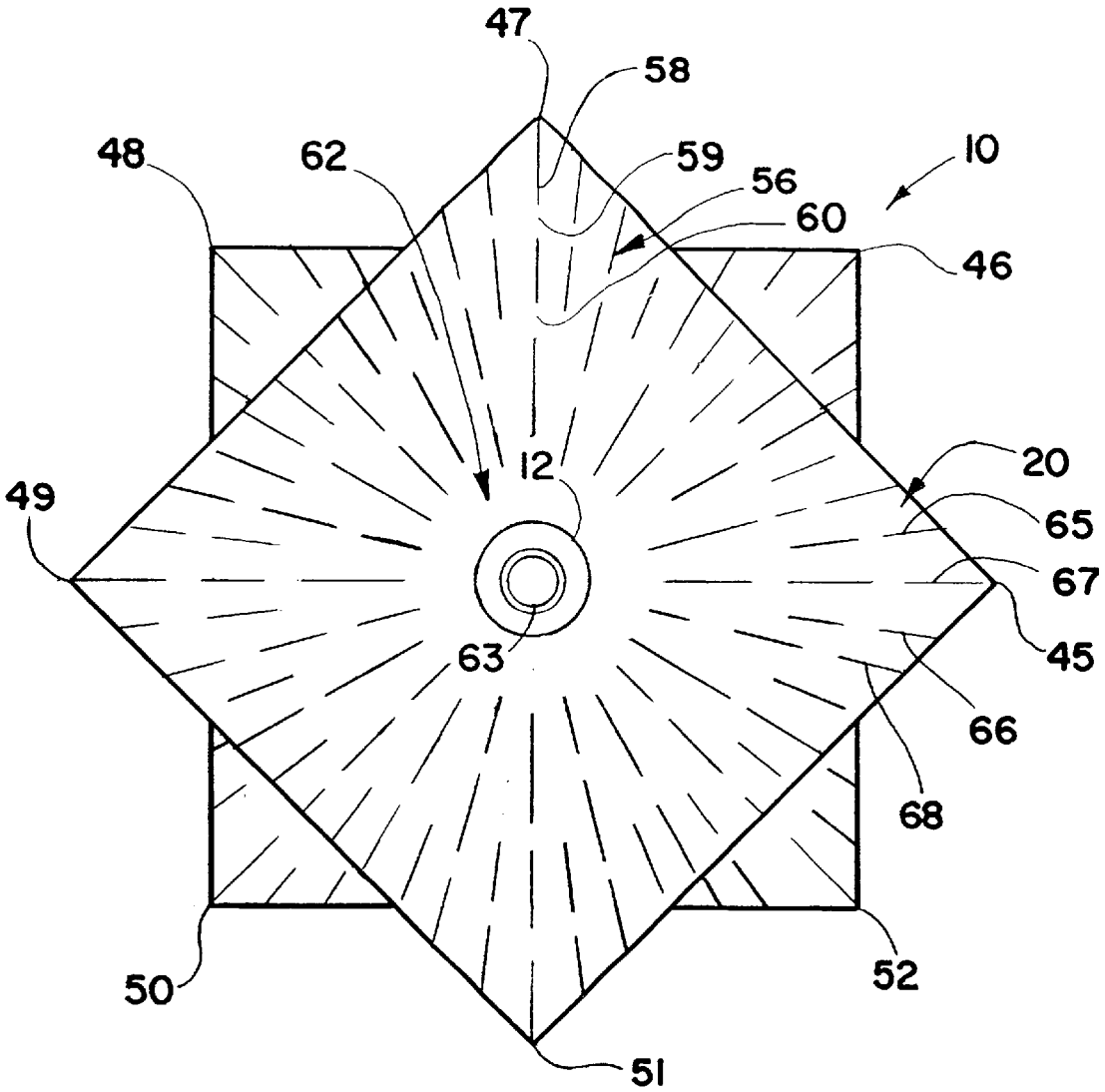
FIG. 1 is an axial end elevation of a finishing star in accordance with the present invention showing the discontinuous radial slits in each sheet of the packs.
Figures 2, 3:
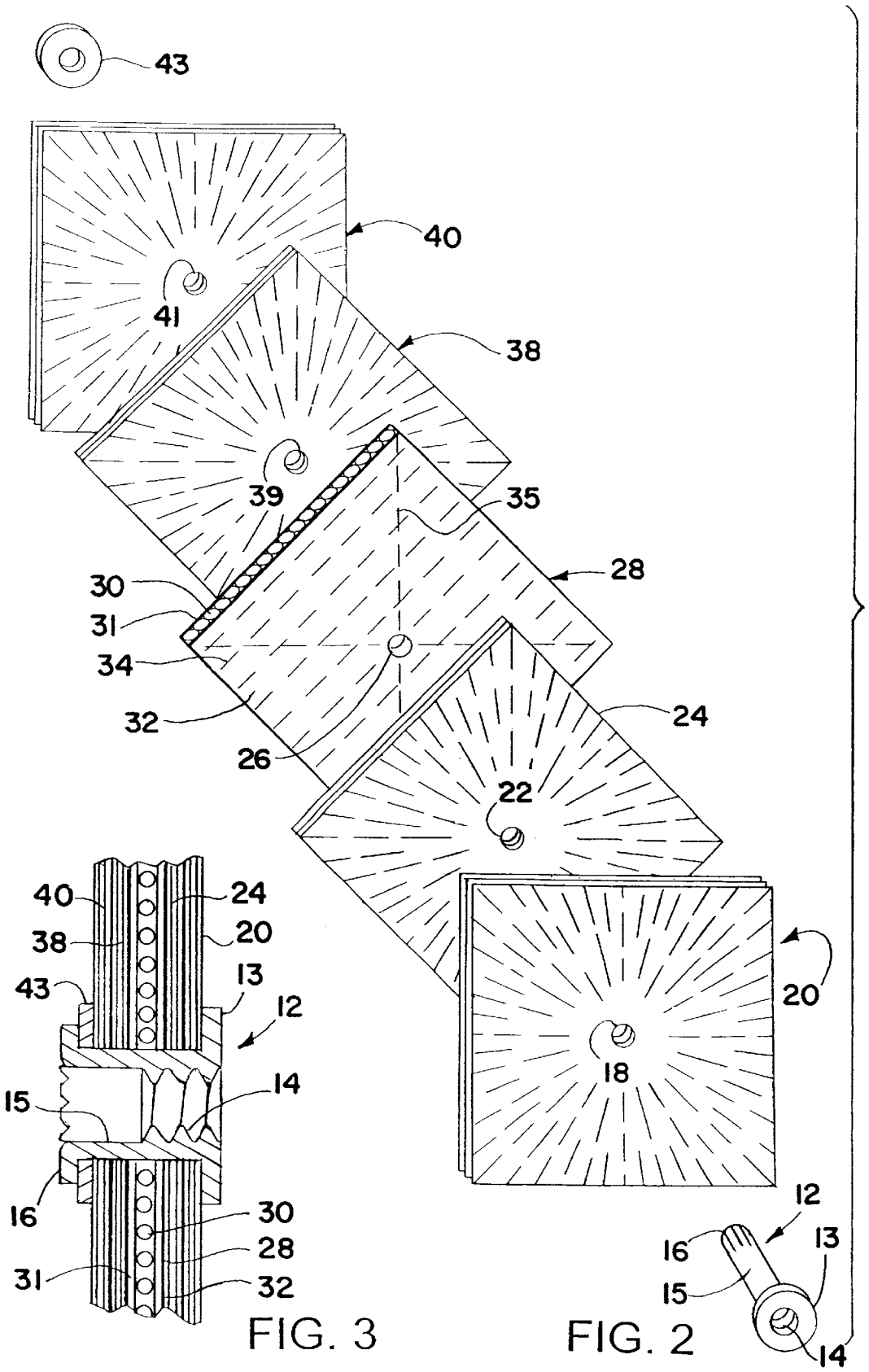
FIG. 2 is an exploded isometric view showing the arrangement of the various packs and the optional middle quilt core.
FIG. 3 is a fragmented axial section of the center mandrel hole forming fastener.

Referring initially to FIGS. 1 and 2 there is illustrated in a spinner or finishing star shown generally at 10 in accordance with the present invention. While the assembled finishing star is shown in the axially elevation of FIG. 1, the components are shown in the exploded isometric view of FIG. 2.

Beginning at the bottom of FIG. 2, it will be seen that the components of the finishing star are cylindrical fastening element 12 which includes a flange 13 on one end and internal threads 14. The cylindrical shank 15 opposite the flange 13 terminates in axially extending fingers 16. The shank fits in a center hole 18 in an outside pack of abrasive sheets shown generally at 20. As shown, the sheets of the pack are rectilinear and more specifically square. The hole 18 is in the center of the pack.

The pack is formed of abrasive sheets such as cloth or paper-backed sandpaper, and as illustrated, the pack may contain three (3) such sheets although fewer or more sheets may be employed.

The shank 15 also extends through a center hole 22 in an inner pack of abrasive sheets seen at 24. The inner pack of abrasive sheets 24 may be the same as the pack 20 except that the inner pack 24 has been rotated 45° about the axis of the tool.

The shank of the fastener 12 also extends through the center hole 26 of a middle core shown generally at 28 which has the same or similar profile configuration as the pack 24. The optional core 28 is in the form of a cloth-sisal quilt which comprises a center core 30 of sisal cord or twine held in place by opposite layers of cloth indicated at 31 and 32. The quilt is unified by rows of stitching indicated at 34 which may extend across the core. Additional radially stitching indicated at 35 may also be provided. The sisal-cloth quilt may be made by a variety of sewing patterns and it will be appreciated that the quilt may be subject to various dip treatments to improve its stiffness, flexibility, and wear-resistance qualities. If employed the sisal-cloth quilt will also act to retain various coolants and/or compound treatments which may be employed with the abrading operation.

Referring again to FIG. 2, there is illustrated another inner pack of abrasive sheets shown at 38 having a center hole 39 through which the shank of the fastener 12 extends.

Finally, there is illustrated an opposite outer pack of abrasive sheets shown generally at 40 having central hole 41 accommodating the shank 15. The outer pack 40 is aligned with the opposite outer pack 20 while the inner packs 24 and 38, as well as the middle core 28, are offset about the axis of the tool 45°. In assembly, the fastener 12 is inserted through the various holes and through the washer 43 on the opposite end. The fingers 16 are coined or swaged back over the outside of the washer 43 and the assembly is held together between the washer 43 and the flange 13 as seen in FIG. 3. The internal threads 14 enable the finishing star or center to be mounted on suitable drive arbor.

In a preferred form, the abrasive on the packs 20 and 24 faces toward the viewer, while the abrasive on the packs 38 and 40 faces away from the viewer in FIG. 2. However, the abrasive on the sheet may face in or out, or in various patterns in both directions. The packs 20, 24, 38 and 40 may each comprise three (3) sheets although more or fewer may be employed.

Although an eight-pointed star is illustrated, it will be appreciated that additional packs may be provided symmetrically offset to provide a star having more equally circumferentially spaced points such as sixteen, thirty-two or even more.

Referring now to FIG. 1, it will be seen that when the packs are assembled the tool has the profile configuration of an eight-pointed star. The tips are shown at 45, 46, 47, 48, 49, 50, 51 and 52 in FIG. 1. Each tip is formed by an equilateral triangle formed by the projecting corner of one of the square sheet packs.

Also as shown in FIG. 1, each of the rectilinear abrasive sheets is provided with an array of discontinuous radial slits as shown generally at 56. In the illustrated embodiment, there are 48 such radial slits which vary in radial length because of the rectilinear or square configuration of the sheet. Some slits included two (2) discontinuities such as the corner slits 58, the discontinuities being shown at 59 and 60. The slits extend radially from an unslit center section shown generally at 62 around the mandrel hole 63 formed by the fastener 12.

It is noted that the discontinuity in each slit is radially offset from the discontinuity in a circumferentially adjacent slit. Also it is noted that circumferentially alternating radial slits such as seen at 65 and 66 do not extend radially inwardly to the same extent as adjacent slits shown at 67 and 68. As illustrated, the root diameter of the circumferentially alternating slits 65 and 66 is about twice that of the adjacent slits 67 and 68. The slit pattern as illustrated in FIG. 1 provides the desired flexibility for the sheets or packs for conformance to the work, particularly edges, ridges or projections. The discontinuity of the radial slits keeps the sheets from forming separate fingers in operation which might quickly disintegrate as the tool wears to a round shape.

Referring now to FIG. 3, there is illustrated the coined or swaged two-part fastener which clamps the various components of the finishing star together. The internal threads are shown at 14. The fingers 16 extend through the washer 43 and are bent outwardly as indicated to coin or swage the fingers to the shape shown holding the washer 43 against the opposite side of the spinner. Reading from right to left, there is shown the pack 20, the pack 24, the middle core 28 which comprises the central layer of sisal cords or twine 30 with opposite cloth layers 31 and 32. Finally, there is the opposite inner pack 38 and the opposite outer pack 40. When assembled in the manner shown, the components are tightly clamped together and will not relatively rotate about the drive axis of the tool which is through the center of the mandrel hole. As indicated, the abrasive surface on the sheets may face in or out, or in a pattern of both directions. The middle core provides a carrier for coolant or treatment compound and itself may be dip treated for wear and performance characteristics.

It can now been seen that there is provided a rotary abrasive tool in the form of a star utilizing angularly offset packs of abrasive sheets or sandpaper each with radial slits, but with discontinuous slits. An internally threaded two-part fastener secures the packs together and forms the center arbor or mandrel hole. The optional cloth-sisal quilt provides the desired cushioning or backing for the tool and may also serve as a carrier for coolant and/or compound. The tools may vary in size from about two-inches in diameter to eight-inches or more.

Although the invention has been shown and described with respect to certain preferred embodiments, it is obvious that equivalent alterations and modifications will occur to others skilled in the art upon the reading and understanding of this specification. It will be appreciated that suitable features in one of the embodiments may be incorporated in another of the embodiments, if desired. The present invention includes all such equivalent alterations and modifications, and is limited only be the scope of the claims.

What is claimed is:

1. An abrasive rotary finishing star tool comprising inner and outer packs of rectilinear abrasive sheets with a center drive mandrel hole, the inner packs of sheets being offset about the rotary axis of the tool from the outer packs of sheets, and discontinuous radial slits in each sheet, said sheets being square and said slits extending radially from an unslit section of the sheet around the mandrel hole.

2. An abrasive finishing star as set forth in claim 1, wherein the discontinuity in each slit is radially offset from the discontinuity in a circumferentially adjacent slit.

3. An abrasive finishing star as set forth in claim 2, wherein circumferentially alternating radial slits do not extend radially inwardly to the same extent as adjacent slits.

4. An abrasive finishing star as set forth in claim 3, wherein the root diameter of said circumferentially alternating slits is about twice that of adjacent slits.

5. An abrasive finishing star as set forth in claim 1, wherein circumferentially alternating slits have a larger root diameter than circumferentially adjacent slits.

6. An abrasive rotary finishing star tool comprising inner and outer packs of rectilinear abrasive sheets with a center drive mandrel hole, the inner packs of sheets being offset about the rotary axis of the tool from the outer packs of sheets, and discontinuous radial slits in each sheet, including a backing core in the middle of the tool.

7. An abrasive finishing star as set forth in claim 6, wherein said backing core is a cloth-sisal quilt.

8. An abrasive finishing star as set forth in claim 7, wherein said backing core is formed with outer cloth layers sewn to a sisal center core.

9. An abrasive finishing star as set forth in claim 8, wherein said backing core is substantially the same size as said sheets and is angularly oriented in the same manner as said inner packs of sheets.

10. An abrasive rotary finishing star tool comprising inner and outer packs of square abrasive sheets with a center drive mandrel hole, the inner packs of sheets being offset about the rotary axis of the tool from the outer packs of sheets, and a backing core in the middle of the tool between the inner packs of sheets.

11. An abrasive finishing star as set forth in claim 10, wherein said backing core is a cloth-sisal quilt.

12. An abrasive finishing star as set forth in claim 11, wherein said quilt is formed with a sisal inner core and outer cloth layers all sewn together.

13. An abrasive finishing star as set forth in claim 12, wherein said backing core is oriented in the same manner as said inner packs of sheets.

* * * * *